US009395108B2

(12) United States Patent
Morie et al.

(10) Patent No.: US 9,395,108 B2
(45) Date of Patent: Jul. 19, 2016

(54) CRYOGENIC REFRIGERATOR

(71) Applicant: SUMITOMO HEAVY INDUSTRIES, LTD., Tokyo (JP)

(72) Inventors: Takaaki Morie, Tokyo (JP); Mingyao Xu, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 225 days.

(21) Appl. No.: 14/151,910

(22) Filed: Jan. 10, 2014

(65) Prior Publication Data

US 2014/0202173 A1 Jul. 24, 2014

(30) Foreign Application Priority Data

Jan. 21, 2013 (JP) ..... 2013-008755

(51) Int. Cl.
*F25B 9/00* (2006.01)
*F25B 9/14* (2006.01)

(52) U.S. Cl.
CPC ..... *F25B 9/14* (2013.01); *F25B 2309/001* (2013.01)

(58) Field of Classification Search
CPC ..... F25B 9/14; F25B 9/145; F25B 2309/003
USPC ..... 62/6, 55.5
See application file for complete search history.

(56) References Cited

U.S. PATENT DOCUMENTS 3,717,004 A * 2/1973 O'Neil ..... F02G 1/0445 60/517
4,446,701 A 5/1984 Suzuki et al.

FOREIGN PATENT DOCUMENTS

| | | |
|---|---|---|
| JP | S58-190663 | 11/1983 |
| JP | S62-116867 | 5/1987 |
| JP | 63-053469 | 10/1988 |
| JP | H01-175272 U | 12/1989 |
| JP | 2001-280728 | 10/2001 |

* cited by examiner

*Primary Examiner* — Melvin Jones
(74) *Attorney, Agent, or Firm* — IPUSA, PLLC

(57) ABSTRACT

A cryogenic refrigerator includes a compressor that compresses a working gas; a displacer to which the working gas compressed by the compressor is supplied; a drive mechanism that includes a drive shaft and is configured to drive the displacer; a motor that drives the drive mechanism; a housing that accommodates the drive mechanism; a valve mechanism that adjusts a pressure of the working gas supplied to the displacer; a pipe that supplies the working gas from the compressor to the valve mechanism; and a branch pipe that branches out from the supply pipe and is connected to a space formed between the drive shaft and the housing.

6 Claims, 8 Drawing Sheets

CRYOGENIC REFRIGERATOR

CROSS-REFERENCE TO RELATED APPLICATIONS

The present application is based on and claims the benefit of priority to Japanese Patent Application No. 2013-008755, filed on Jan. 21, 2013, the entire contents of which are incorporated herein by reference.

BACKGROUND OF THE INVENTION

1. Field of the Invention

The present invention relates to a cryogenic refrigerator that drives a displacer using a motor.

2. Description of the Related Art

Gifford-McMahon (GM) refrigerators are known as cryogenic refrigerators that can produce cryogenic temperatures. A GM refrigerator produces a refrigeration effect using the Gifford-McMahon refrigeration cycle, which involves reciprocating a displacer within a cylinder using a drive mechanism to create a volume change in a space within the cylinder.

A high-pressure working gas that is generated at a compressor is supplied to the displacer at a predetermined timing using a valve mechanism. Also, a regenerator material is arranged inside the displacer in order to improve cooling efficiency.

Various types of drive mechanisms are known for driving the displacer. In one known example, a motor is used as a drive source, a scotch yoke that is arranged within a housing is used to convert a rotation of the motor into a reciprocating motion, and a drive shaft that interconnects the scotch yoke and the displacer is used to drive the displacer to reciprocate.

Also, a technique is known for reducing a torque applied to the motor of such a GM refrigerator by providing a space at a front end portion of the drive shaft within the housing (referred to as "assist space" hereinafter) and adjusting the pressure within the assist space.

SUMMARY OF THE INVENTION

According to one embodiment of the present invention, a cryogenic refrigerator includes a compressor that compresses a working gas; a displacer to which the working gas compressed by the compressor is supplied; a drive mechanism that includes a drive shaft and is configured to drive the displacer; a motor that drives the drive mechanism; a housing that accommodates the drive mechanism; a valve mechanism that adjusts a pressure of the working gas supplied to the displacer; a pipe that supplies the working gas from the compressor to the valve mechanism; and a branch pipe that branches out from the supply pipe and is connected to a space formed between the drive shaft and the housing.

According to another embodiment of the present invention, a cryogenic refrigerator includes a compressor that compresses a working gas; a displacer to which the working gas compressed by the compressor is supplied; a drive mechanism that includes a drive shaft and is configured to drive the displacer; a motor that drives the drive mechanism; a housing that accommodates the drive mechanism; a valve mechanism that adjusts a pressure of the working gas supplied to the displacer; a high-pressure fluid supply source that supplies a high-pressure fluid to an external part of the housing; and a supply pipe that is connected to a space formed between the drive shaft and the housing and is configured to supply the high-pressure fluid from the high-pressure fluid supply source to the space.

DETAILED DESCRIPTION OF THE PREFERRED EMBODIMENTS

Figure 1:
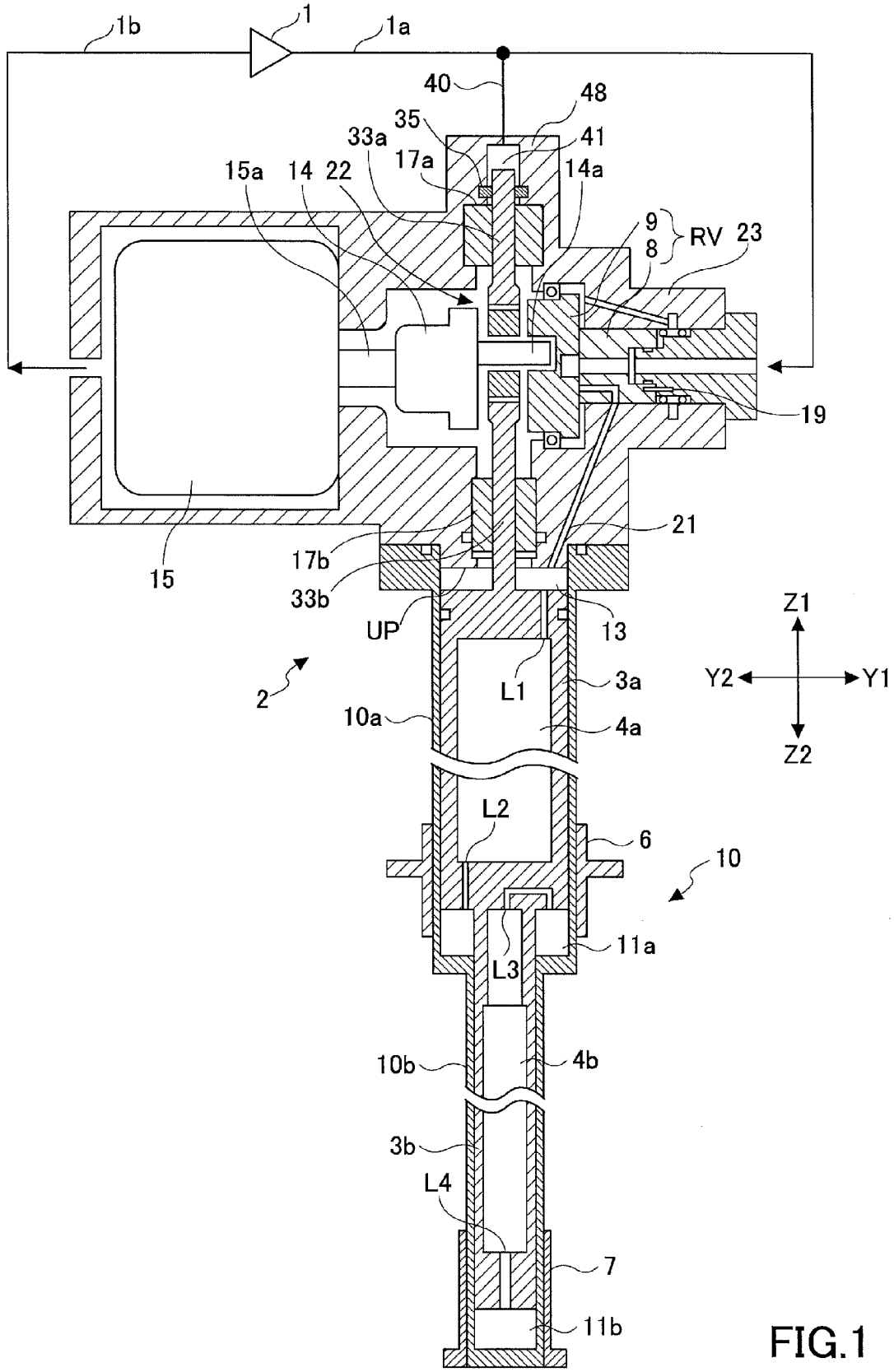
FIG. 1 is a cross-sectional view of a GM refrigerator according to an embodiment of the present invention.

As described above, Japanese Examined Patent Publication No. 63-053469 discloses a GM refrigerator having an assist space provided at a front end portion of a drive shaft arranged within a housing. In such a GM refrigerator, a gas flow path extending from a valve mechanism to the assist space is arranged within the housing and the interconnection between a high-pressure side pipe and a low-pressure side pipe of a compressor is switched.

However, the GM refrigerator as described above has a rather complicated structure and has issues concerning leakage of refrigerant gas at the gas flow path.

Also, as the capacity of the drive source is improved and the cooling capacity is increased as a result, there may be incidences where the drive torque momentarily increases during an operation cycle. This is caused by a pressure loss occurring within the displacer and may cause the motor driving the scotch yoke to fall out of synch (slip) depending on the amount of increase of the drive torque.

In view of the above, there is a demand for a cryogenic refrigerator that is capable of preventing the motor from falling out of synch (slipping) without complicating its structure.

According to one embodiment of the present invention, a cryogenic refrigerator includes a compressor that compresses a working gas; a displacer to which the working gas compressed by the compressor is supplied; a drive mechanism that includes a drive shaft and is configured to drive the displacer; a motor that drives the drive mechanism; a housing that accommodates the drive mechanism; a valve mechanism that adjusts a pressure of the working gas supplied to the displacer; a pipe that supplies the working gas from the compressor to the valve mechanism; and a branch pipe that branches out from the supply pipe and is connected to a space formed between the drive shaft and the housing.

According to another embodiment of the present invention, a cryogenic refrigerator includes a compressor that compresses a working gas; a displacer to which the working gas compressed by the compressor is supplied; a drive mechanism that includes a drive shaft and is configured to drive the displacer; a motor that drives the drive mechanism; a housing that accommodates the drive mechanism; a valve mechanism that adjusts a pressure of the working gas supplied to the displacer; a high-pressure fluid supply source that supplies a high-pressure fluid to an external part of the housing; and a supply pipe that is connected to a space formed between the drive shaft and the housing and is configured to supply the high-pressure fluid from the high-pressure fluid supply source to the space.

According to an aspect of the present invention, by having a pressurized fluid supplied to a space formed between a drive shaft and a housing of a GM refrigerator, the drive shaft may be forced by the pressure of the fluid supplied to the space and a motor load torque applied to a motor may be reduced as a result so that the motor may be prevented from falling out of synch (slipping).

In the following, exemplary embodiments of the present invention are described with reference to the accompanying drawings.

FIG. 1 is a cross-sectional view of a cryogenic refrigerator according to a first embodiment of the present invention. The cryogenic refrigerator illustrated in FIG. 1 corresponds to a GM refrigerator.

The GM refrigerator of the present embodiment includes a compressor 1 and a cold head 2. The cold head 2 includes a housing 23 and a cylinder part 10.

The compressor 1 draws in working gas via a suction port that is connected to an exhaust pipe 1*b*, and after compressing the working gas, the compressor 1 supplies the compressed working gas (high-pressure working gas) to a supply pipe 1*a* via a discharge port. In one example, helium gas may be used as the working gas.

The GM refrigerator as illustrated in FIG. 1 corresponds to a two-stage type GM refrigerator in which the cylinder part 10 includes a first-stage cylinder 10*a* and a second-stage cylinder 10*b*. The first-stage cylinder 10*a* has a first-stage displacer 3*a* installed therein. The second-stage cylinder 10*b* has a second-stage displacer 3*b* installed therein. Note that in the following descriptions, the first-stage displacer 3*a* and the second-stage displacer 3*b* may simply be referred to as displacers 3*a* and 3*b*.

The first-stage displacer 3*a* and the second-stage displacer 3*b* are linked to each other and are configured to be capable of reciprocating in the cylinder axis directions within the first-stage cylinder 10*a* and the second-stage cylinder 10*b*, respectively. The first-stage displacer 3*a* and the second-stage displacer 3*b* have gas flow paths formed therein, and the gas flow paths of the first-stage displacer 3*a* and the second-stage displacer 3*b* are respectively filled with a first-stage regenerator material 4*a* and a second-stage regenerator material 4*b*.

A drive shaft 33*b* is arranged to extend upward (Z1 direction in FIG. 1) from the first-stage cylinder 10*a*, which is arranged on the upper side. The drive shaft 33*b* is connected to a scotch yoke mechanism 22, which is described below.

A first-stage expansion chamber 11*a* is formed at one end portion of the first-stage cylinder 10*a* toward the second-stage cylinder 10*b* side (Z2 direction side end portion in FIG. 1). An upper chamber 13 is formed at the other end portion of the first-stage cylinder 10*a* (Z1 direction side end portion in FIG. 1). Further, a second-stage expansion chamber lib is formed at one end portion of the second-stage cylinder 10*b* opposite the first-stage cylinder 10*a* (Z2 direction side end portion in FIG. 1).

The upper chamber 13 and the first-stage expansion chamber 11*a* are interconnected via a gas flow path L1, the first-stage regenerator material 4*a*, and a gas flow path L2. The first gas flow path L1 is formed at the upper side of the first-stage displacer 3*a*. The first-stage regenerator material 4*a* is arranged within a gas flow path for the working gas that is formed within the first-stage displacer 3*a*. The gas flow path L2 is formed at the lower side of the first-stage displayer 3*a*.

The first-stage expansion chamber 11*a* and the second-stage expansion chamber 11*b* are interconnected via a gas flow path L3, the second-stage regenerator material 4*b*, and a gas flow path L4. The gas flow path L3 is formed at the upper side of the second-stage displacer 3*b*, and the gas flow path L4 is formed at the lower side of the second-stage displacer 3*b*.

A first-stage cooling stage 6 is mounted on the outer peripheral face of the first-stage cylinder 10*a* at a position facing the first-stage expansion chamber 11*a*. Also, a second-stage cooling stage 7 is arranged on the outer peripheral face of the second-stage cylinder 10*b* at a position facing the second-stage expansion chamber 11*b*.

Figure 2:
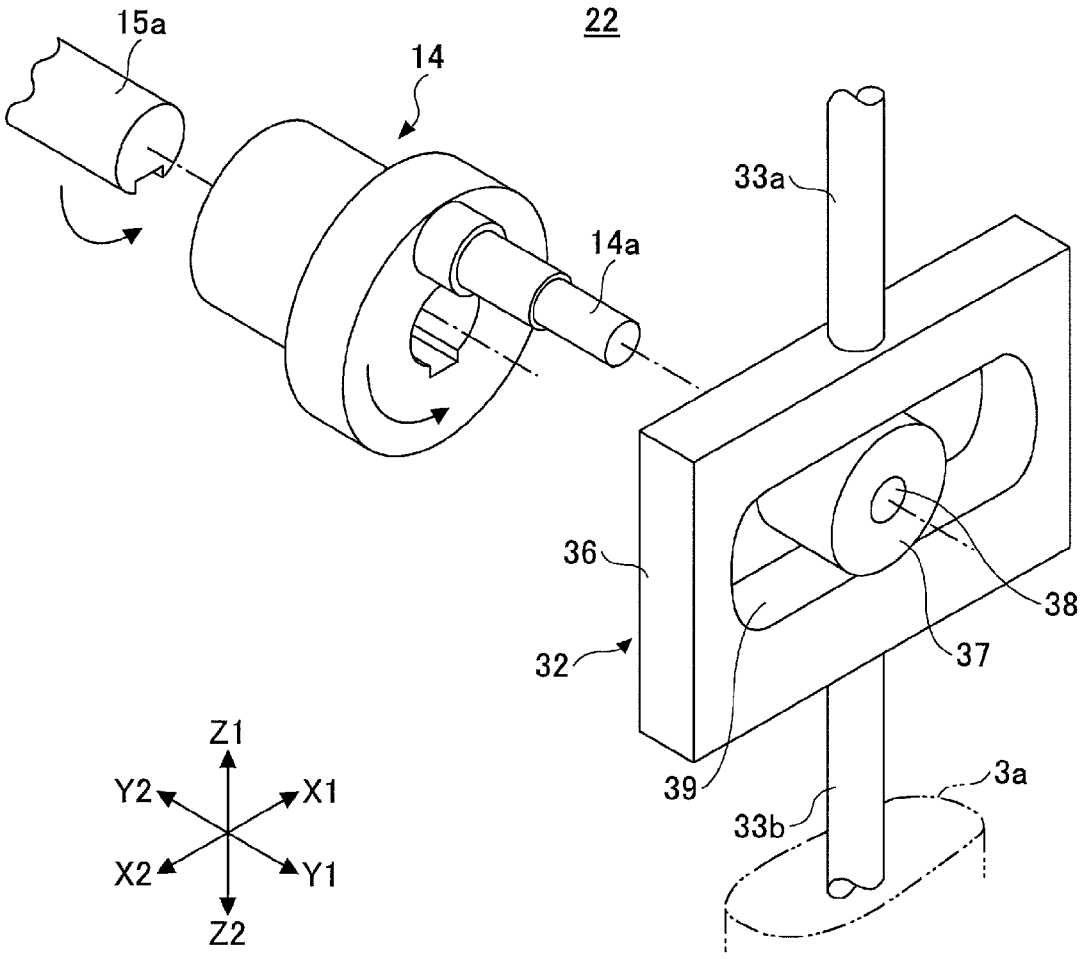
FIG. 2 is an enlarged view of a scotch yoke mechanism.

The first-stage displacer 3*a* and the second-stage displacer 3*b* are driven by the scotch yoke mechanism 22 (corresponding to an exemplary embodiment of a drive mechanism) to reciprocate in upward and downward directions (Z1 and Z2 directions in FIG. 1) within the first-stage cylinder 10*a* and the second-stage cylinder 10*b*, respectively. FIG. 2 is an enlarged view of the scotch yoke mechanism 22.

The scotch yoke mechanism 22 includes a crank 14 and a scotch yoke 32.

The crank 14 is fixed to a drive rotation shaft 15*a* of a motor 15. The crank 14 includes an eccentric pin 14*a* that is eccentrically positioned with respect to the mount position of the drive rotation shaft 15*a*. Thus, when the crank 14 is mounted to the drive rotation shaft 15*a*, the drive rotation shaft 15*a* and the eccentric pin 14*a* are eccentrically positioned with respect to each other.

The scotch yoke 32 includes drive shafts 33*a* and 33*b*, a yoke plate 36, and a roller bearing 37. The drive shafts 33*a* and 33*b* are respectively arranged to extend in upward and downward directions (Z1 and Z2 directions in FIG. 2) from an upper side center portion and a lower side center portion of the yoke plate 36.

The drive shaft 33*a* extends upward (Z1 direction in FIG. 2) from the yoke plate 36 and is movably held by a slide shaft bearing 17*a* that is arranged within the housing 23. Further, an upper end portion of the drive shaft 33*a* is inserted into an assist space 41 (assist chamber 48), which is described in detail below.

The drive shaft 33*b* extends downward (Z2 direction in FIG. 2) from the yoke plate 36 and is movably held by a slide shaft bearing 17*b* that is arranged within the housing 23. Thus, by having the drive shafts 33*a* and 33*b* slide within the slide shaft bearings 17*a* and 17*b*, the scotch yoke 32 may reciprocate in upward and downward directions (Z1 and Z2 directions in FIG. 2) within the housing 23.

Also, a laterally long window 39 is formed at the yoke plate 36. The laterally long window 39 is arranged to extend in directions substantially perpendicular to the extending directions of the drive shafts 33*a* and 33*b* (X1 and X2 directions in FIG. 2).

The roller bearing 37 is arranged within the laterally long window 39. The roller bearing 37 is configured to be capable of rolling within the laterally long window 39. Further, an engagement hole 38 is formed at a center portion of the roller bearing 37, and the engagement hole 38 is configured to engage with the eccentric pin 14*a*.

Accordingly, when the motor 15 drives the drive rotation axis 15*a* while the eccentric pin 14*a* is in engagement with the roller bearing 37, the eccentric pin 14*a* turns around, and in this way, the scotch yoke 32 reciprocates in the Z1 and Z2 directions of FIG. 2. Meanwhile, the roller bearing 37 reciprocates within the laterally long window 39 in the X1 and X2 directions in FIG. 2.

The drive shaft 33*b*, which is arranged at the lower side of the scotch yoke 32, is connected to the first-stage displacer 3*a*. Accordingly, when the scotch yoke 32 reciprocates in the Z1 and Z2 directions, the first-stage displacer 3*a*, which is connected to the scotch yoke 32, and the second-stage displacer 3*b*, which is connected to the first-stage displacer 3*a*, also reciprocate in the Z1 and Z2 directions within the first-stage cylinder 10*a* and the second-stage cylinder 10*b*, respectively.

As can be appreciated from above, the scotch yoke mechanism 22 is driven by the motor 15. Thus, when loads are applied to the first-stage displacer 3*a* and the second-stage displacer 3*b* and the shift resistance with respect to the reciprocating motion of the drive shafts 33*a* and 33*b* in the Z1 and Z2 directions is increased, a corresponding load is applied to the motor 15 as a motor load torque.

Referring to FIG. 1, the assist chamber 48 is formed at the housing 23 at a position corresponding to where the drive shaft 33*a* is positioned. The assist space 41 is formed within the assist chamber 48. The assist space 41 is formed between the upper end portion of the drive shaft 33*a* and the housing 23. The drive shaft 33*a*, which extends upward from the yoke plate 36, is configured to be capable of reciprocating in the Z1 and Z2 directions within the assist space 41.

Also, a slipper seal 35 is arranged at an end portion of the assist space 41 toward the scotch yoke mechanism 22 side slightly above the slide shaft bearing 17*a*. The slipper seal 35 is arranged to seal the space between the inner wall of the assist space 41 and the drive shaft 33*a* so that the assist space 41 may be hermetically sealed and separated from the internal space of the housing 23. The drive shaft 33*a* is configured to be capable of reciprocating within the assist space 41 while maintaining the hermetically sealed state of the assist space 41. In this way, the drive shaft 33*a* and the assist chamber 48 forms a piston cylinder mechanism.

Also, a branch pipe 40 is connected to the assist space 41, the details of which are described below.

In the following, a rotary valve RV corresponding to an exemplary embodiment of a valve mechanism is described with reference to FIG. 1. The rotary valve RV is arranged within a flow path for the working gas between the compressor 1 and the upper chamber 13. By switching the flow path for the working gas, the rotary valve RV may function as a supply valve V1 for guiding the working gas discharged from the discharge port of the compressor 1 into the upper chamber 13, or a discharge valve V2 for guiding the working gas within the upper chamber 13 to the suction port of the compressor 1 as described in detail below.

The rotary valve RV includes a stator valve 8 and a rotor valve 9. The rotor valve 9 is rotatably mounted within the housing 23.

The stator valve 8 is fixed to the housing 23 with a pin 19 and is prevented from rotating. The rotor valve 9 is connected to the eccentric pin 14*a* of the scotch yoke mechanism 22 and is configured to rotate with respect to the stator valve 8 when the eccentric pin 14*a* is rotated. Thus, the rotary valve RV may be driven to rotate the rotor valve 9 through operation of the motor 15 as a drive source.

Also, a gas flow path 21 having one end connected to the upper chamber 13 and the other end connected to the rotary valve RV is formed within the housing 23. When the rotor valve 9 of the rotary valve RV is rotated and the supply valve V1 is opened as a result, the discharge port of the compressor 1 communicates with the upper chamber 13, and the working gas that is compressed to a high pressure by the compressor 1 is supplied from the discharge port of the compressor 1 to the upper chamber 13 via the supply pipe 1*a*.

On the other hand, when the rotor valve 9 of the rotary valve RV is rotated and the discharge valve V2 is opened as a result, the gas flow path 21 communicates with the suction port of the compressor 1, and the working gas that has been reduced to a lower pressure as a result of producing cold flows from the gas flow path 21 to the suction port of the compressor 1 via the exhaust pipe 1*b*.

When the rotor valve 9 is rotated by the motor 15, supply operations for supplying the working gas to the upper chamber 13 and discharge operations for retrieving the working gas from the upper chamber 13 are repeatedly performed. Further, the repetition of the supply and discharge of the working gas and the drive operations for moving the first-stage displacer 3*a* and the second-stage displacer 3*b* back and forth are performed in synch with the rotation of the crank 14.

Figure 3:
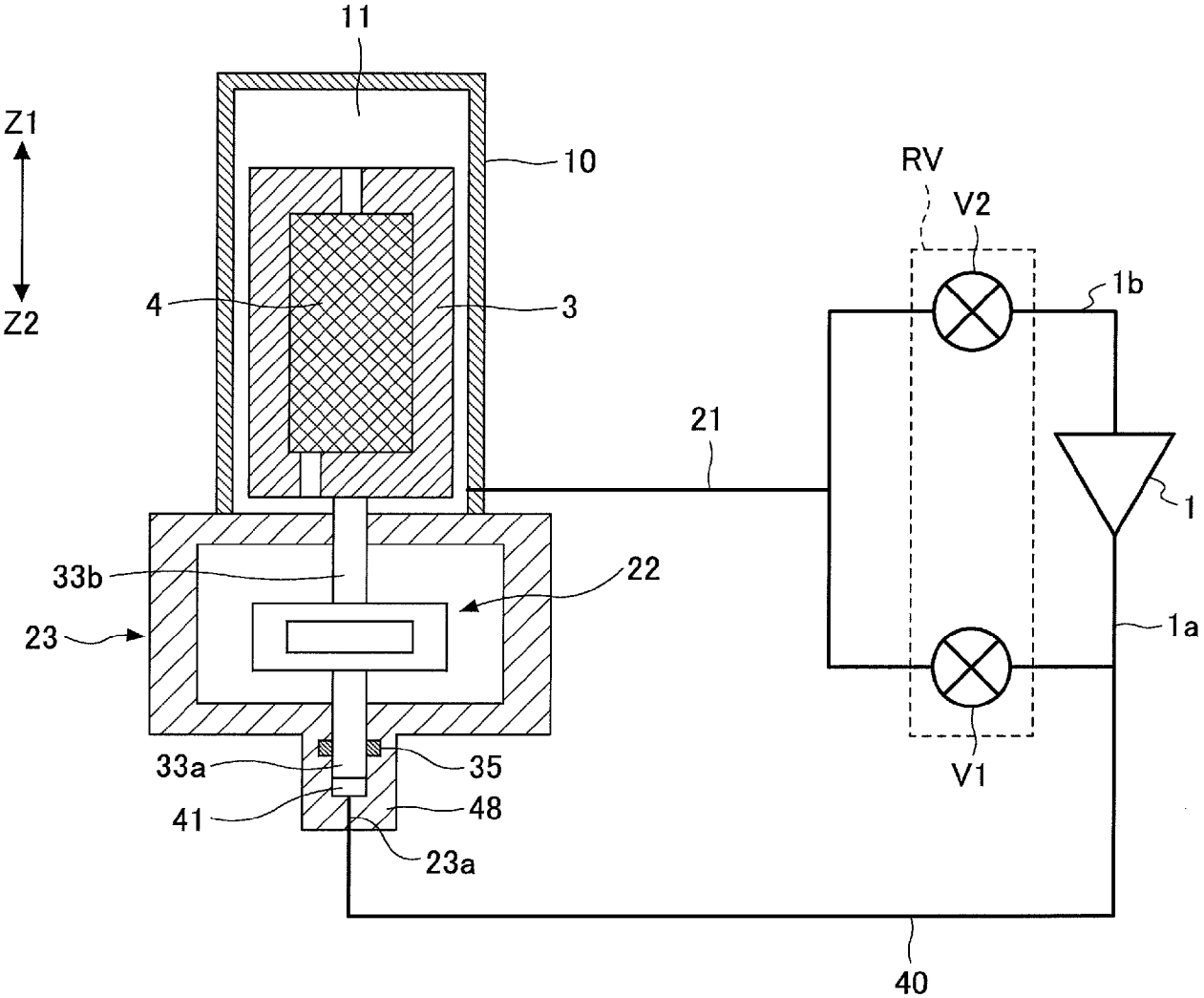
FIG. 3 illustrates a basic configuration of a GM refrigerator according to an embodiment of the present invention.

In the following, the assist space 41 that is formed within the housing 23 and the branch pipe 40 that is connected to the assist space 41 are described in detail with reference to FIG. 3. FIG. 3 illustrates a basic configuration of a GM refrigerator according to an embodiment of the present invention.

In FIG. 3, a single-stage type GM refrigerator is illustrated, and the supply valve V1 and the discharge valve V2 of the rotary valve RV are illustrated in simplified form.

Note that in FIG. 1, the first-stage displacer 3*a* and the second-stage displacer 3*b* are arranged below the scotch yoke mechanism 22. In contrast, in FIG. 3, a displacer 3 is arranged at the upper side (Z1 direction side) of the scotch yoke mechanism 22. In other words, FIG. 3 illustrates the GM refrigerator of FIG. 1 turned upside down with the cylinder part 10 having only one stage.

A GM refrigerator may be arranged in different orientations according to the configuration of the system into which it is implemented. The GM refrigerator in the orientation as illustrated in FIG. 3 may be implemented in various systems including a cryopump, for example.

Note that illustrations of the crank 14, the eccentric pin 14*a*, the motor 15, and the roller bearing 37 are omitted in FIG. 3.

FIG. 3 illustrates a state in which the displacer 3 is moved within the cylinder part 10 to a position that maximizes the volume of an expansion chamber 11. When moving the displacer 3 upward (in the Z1 direction) from such a state, the supply valve V1 is closed and the discharge valve V2 is opened, and in turn, the working gas within the expansion chamber 11 passes through a regenerator material 4 that is arranged within the displacer 3 and flows into the suction port of the compressor 1 via the gas flow path 21 and the rotary valve RV (discharge valve V2).

In the GM refrigerator of the present embodiment, the regenerator material 4 may be densely arranged within the displacer 3 to increase the cooling efficiency, and as a result, the working gas may undergo substantial pressure loss upon passing through the regenerator material 4. A load resulting from such pressure loss may be transmitted to the scotch yoke mechanism 22 via the drive shaft 33*b* and applied to the motor 15 that drives the scotch yoke mechanism 22 as a motor load torque.

Also, in the configuration of FIG. 3 in which the displacer 3 is arranged above the scotch yoke mechanism 22, the weight of the displacer 3 may be applied to the scotch yoke mechanism 22 upon moving the displacer 3 upward. Thus, the weight of the displacer 3 applied to the scotch yoke mechanism 22 may be transmitted to the motor 15 as a motor load torque.

Further, in a case where the GM refrigerator is enlarged owing to an increase in its capacity, for example, the rotary valve RV may have to be enlarged as well. In such a case, the slide resistance of the rotor valve 9 may increase as a result of an increase in the pushing force required for sealing the enlarged structure, and the load for rotating the rotor valve 9 with the increased slide resistance may also be applied to the motor 15 as a motor load torque.

As can be appreciated, a large amount of motor load torque may be applied to the motor 15 in various situations. When the motor load torque applied to the motor 15 reaches a value that is greater than or equal to a predetermined value, the motor 15 may fall out of synch (slip) and may not be able perform normal cycle operations as described above.

In the GM refrigerator of the present embodiment, the assist space 41 is formed at the housing 23 at a position corresponding to where the drive shaft 33*a* is positioned. The drive shaft 33*a* is configured to be capable of reciprocating within the assist space 41 in the reciprocating directions of the displacer 3 (Z1 and Z2 directions in FIG. 3).

The branch pipe 40 is connected to the assist space 41. The branch pipe 40 branches out from the supply pipe 1*a*, which interconnects the compressor 1 and the supply valve V1. In this way, high-pressure working gas that is generated at the compressor 1 may be supplied to the assist space 41 via the branch pipe 40.

In the following, exemplary workings of the branch pipe 40 and the assist space 41 are described.

As described above, the high-pressure working gas generated at the compressor 1 is supplied to the branch pipe 40. By arranging the branch pipe 40 to branch out from the supply pipe 1*a* at the upstream side of the supply valve V1, the high-pressure working gas may be supplied to the assist space 41 via the branch pipe 40 on a steady basis.

Also, in the GM refrigerator of the present embodiment, the slipper seal 35 is arranged at the end portion of the assist space 41 toward the scotch yoke mechanism 22 side to seal the space between the inner wall of the assist space 41 and the drive shaft 33*a*. In this way, the assist space 41 may be hermetically sealed and separated from the internal space of the housing 23, and the high-pressure working gas supplied to the assist space 41 may be prevented from leaking into the internal space of the housing 23.

When the high-pressure working gas is supplied to the assist space 41, the drive shaft 33*a* is forced to move in the upward direction. As described above, the drive shaft 33*a* is connected to the displacer 3 via the scotch yoke mechanism 22. Thus, the displacer 3 is forced to move in the upward direction (in the direction that would cause the volume of the expansion chamber 11 to become smaller) by the pressure of the working gas supplied to the assist space 41.

That is, the pressure of the working gas supplied to the assist space 41 acts as an assist force for assisting the scotch yoke mechanism 22 in forcing the displacer 3 to move in the upward direction. Such an assist force may reduce the motor load torque applied to the motor 15.

As can be appreciated from above, in the GM refrigerator of the present embodiment, the working gas supplied to the assist space 41 may reduce the motor load torque applied to the motor 15. Accordingly, the motor 15 may be prevented from falling out of synch (slipping) even in a case where the working gas passing through the regenerator material 4 undergoes substantial pressure loss, a case where the weight of the displacer 3 is applied to the motor 15, and/or a case where the rotary valve RV is enlarged to accommodate an increase in the output of the GM refrigerator, for example.

Also, in the GM refrigerator of the present embodiment, the branch pipe 40 is arranged outside the housing 23 and is connected to the assist space 41 from outside the housing 23. Specifically, a gas flow hole 23*a* is formed at the housing 23 at a position corresponding to the assist space 41, and one end portion of the branch pipe 40 is fixed to the housing 23 so that the branch pipe 40 communicates with the outer end portion of the gas flow hole 23*a*.

By arranging the branch pipe 40 outside the housing 23 and connecting the branch pipe 40 to the assist space 41 from outside the housing 23 as described above, the configuration of the housing 23 may be simplified compared to a case where a pipe for interconnecting the assist space 41 and the compressor 1 is provided within the housing 23, for example.

Also, in the case where a pipe for interconnecting the assist space 41 and the compressor 1 is provided within the housing 23, additional gas flow paths for the working gas may have to be formed at the housing 23 and the stator valve and the rotor valve making up the rotary valve RV, for example, and additional sealing mechanisms may have to be arranged. As a result, the configuration of the GM refrigerator may become complicated and the risk of internal leakage of the working gas may increase.

In this respect, by connecting the branch pipe 40 to the assist space 41 from outside the housing 23 as in the GM refrigerator of the present embodiment, the configuration of the GM refrigerator may be simplified and the risk of internal leakage may be reduced, for example.

Figure 7:
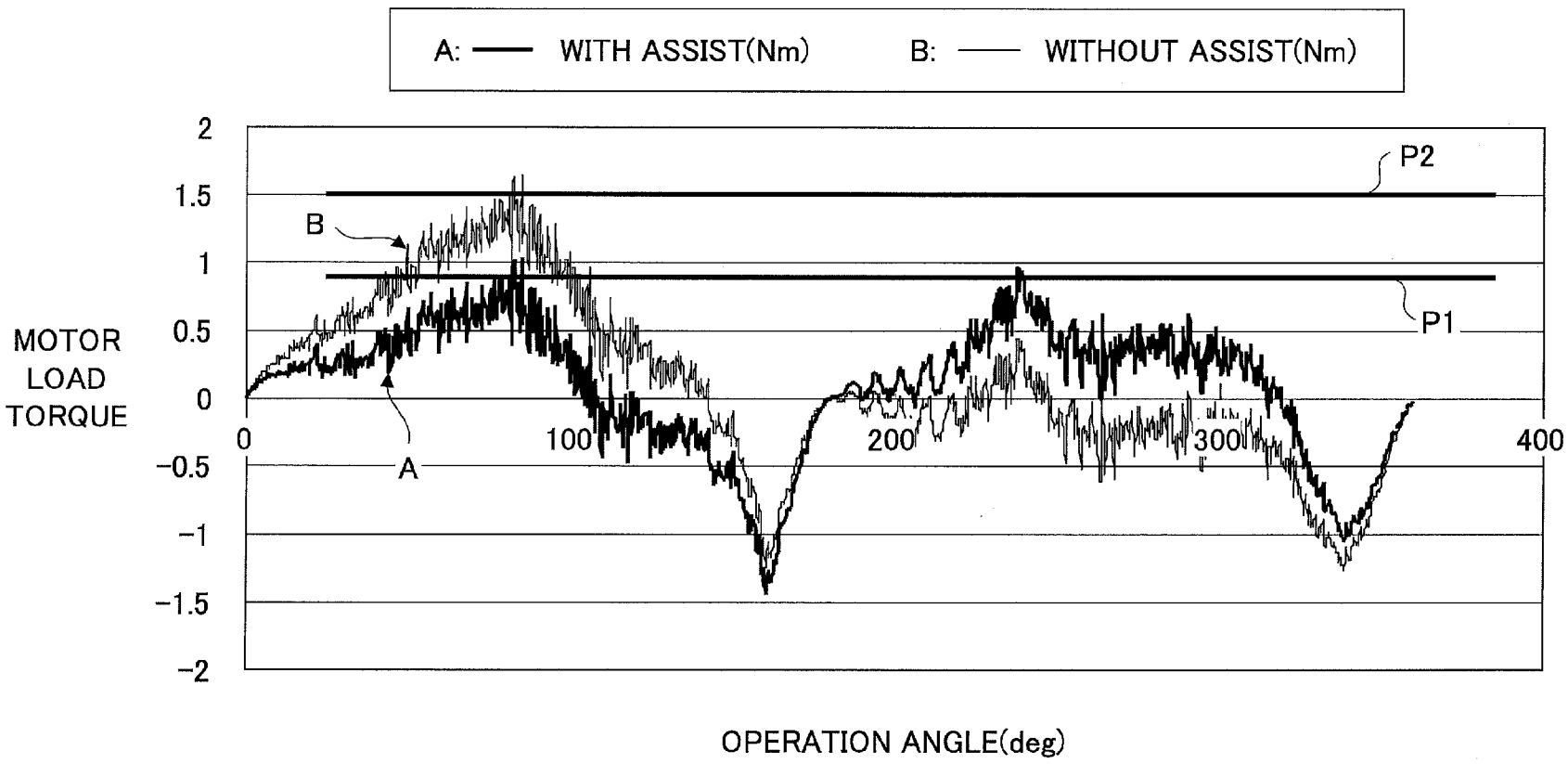
FIG. 7 is a graph indicating a motor load torque of a GM refrigerator according to an embodiment of the present invention.

FIG. 7 is a graph indicating a motor load torque applied to the motor 15 of the GM refrigerator illustrated in FIG. 3 and a motor load torque applied to a motor of a conventional GM refrigerator as a comparison example. Specifically, in FIG. 7, the motor load torque applied to the motor 15 of the GM refrigerator according to the present embodiment is represented by bold line A (referred to as "motor load torque A of the present embodiment" hereinafter), and the motor load torque applied to the motor of the conventional GM refrigerator is represented by line B (referred to as "motor load torque B of the comparison example" hereinafter). Also, in the graph of FIG. 7, the horizontal axis represents the operation angle (crank angle) and the vertical axis represents the motor load torque. The operation angle is equal to 0 degrees when the volume of the expansion chamber 11 is at its maximum. Note that the conventional GM refrigerator used as the comparison example does not include the branch pipe 40 and the assist space 41 but may have a similar configuration to that of the GM refrigerator of the present embodiment in other aspects.

When the operation angle is within a range of 0 degrees to approximately 180 degrees, the motor load torque A of the present embodiment is less than the motor load torque B of the comparison example. Such a difference may occur because the motor load torque applied to the motor 15 of the GM refrigerator of the present embodiment may be reduced by the pressure of the working gas within the assist space 41 acting as an assist force for forcing the displacer 3 to move in the upward direction as described above.

On the other hand, when the operation angle is within a range of approximately 180 degrees to approximately 360 degrees, the motor load torque A of the present embodiment is greater than the motor load torque B of the comparison example. That is, as described above, in the GM refrigerator of the present embodiment, the working gas is supplied to the assist space 41 on a steady basis. Accordingly, when the displacer 3 is moved downward in the Z2 direction (i.e., when the displacer 3 is moved in the direction that would cause the volume of the expansion chamber 11 to become larger), the pressure of the working gas supplied to the assist space 41 is applied to the motor 15 as a motor load.

With respect to the torque peak values (maximum absolute values) of the motor load torques, as can be appreciated from FIG. 7, both the motor load torque A of the present embodiment and the motor load torque B of the comparison example reach their peaks when the operation angle is approximately 90 degrees. Assuming the torque peak value of the motor load torque A of the present embodiment is denoted as P1 and the torque peak value of the motor load torque B of the comparison example is denoted as P2, their relationship may be expressed as P2>P1. That is, the torque peak value P1 of the motor load torque A of the present embodiment may be reduced to approximately ⅗ of the torque peak value P2 of motor load torque B of the comparison example.

Note that the motor of a GM refrigerator is most likely to fall out of synch (slip) when the motor load torque is at its peak. As can be appreciated from FIG. 7, by providing the branch pipe 40 and the assist space 41 in the GM refrigerator, the torque peak value of the motor load torque may be reduced. In this way, the motor 15 of the GM refrigerator of the present embodiment may be prevented from falling out of synch (slipping).

On the other hand, when the operation angle is within the range of approximately 180 degrees to approximately 360 degrees, the motor load torque A of the present embodiment is greater than the motor load torque B of the comparison example. The motor load torque A of the present embodiment may be greater in this case because the direction in which the displacer 3 is forced to move by the motor 15 and the scotch yoke mechanism 22 is opposite the direction of the assist force of the working gas supplied to the assist space 41. In this way, the torque peak value of the motor load torque applied to the motor 15 of the GM refrigerator of the present embodiment may be suppressed during its operation cycle.

Figure 8:
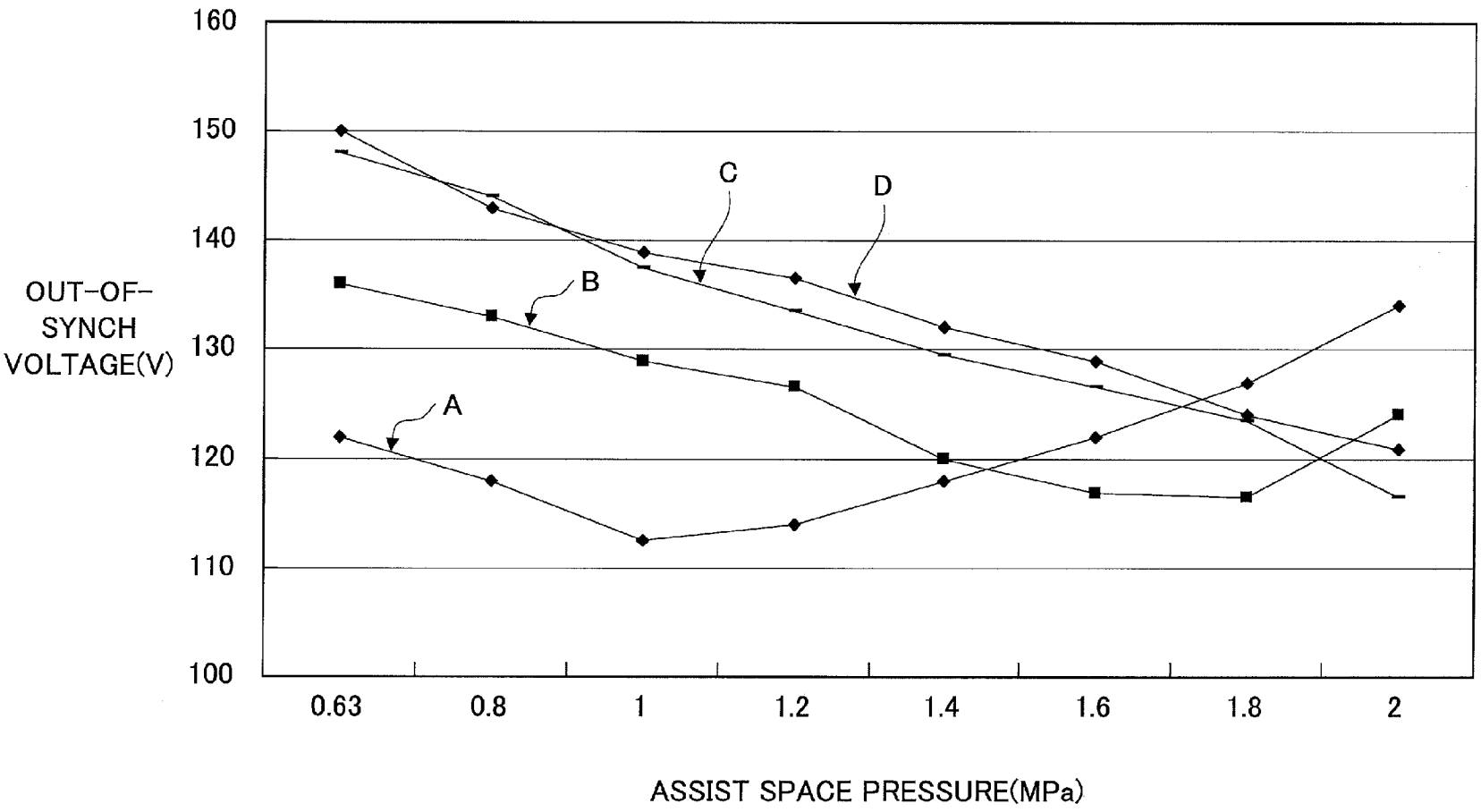
FIG. 8 is a graph indicating a relationship between an assist space pressure and an out-of-synch voltage of a GM refrigerator according to an embodiment of the present invention.

FIG. 8 is a graph illustrating the relationship between the pressure within the assist space 41 (assist space pressure) and an out-of-synch voltage in various cases where the orientation of the GM refrigerator of the present embodiment is changed.

Note that FIG. 8 illustrates the assist space pressure/out-of-synch voltage characteristics of a GM refrigerator having a configuration as illustrated in FIG. 1 with a displacer arranged below a scotch yoke mechanism.

In FIG. 8, the orientation of the GM refrigerator as illustrated in FIG. 1 was set equal to 0 degrees as a reference orientation, and the assist space pressures and the out-of-synch voltages of the GM refrigerator were evaluated in cases where the GM refrigerator was oriented at 0 degrees (A), 90 degrees (B), 150 degrees (C), and 180 degrees (D) with respect to the reference orientation. In the following descriptions, the angle of the GM refrigerator with respect to the reference orientation is referred to as "orientation angle."

Note that "out-of-synch voltage" refers to the voltage applied to the motor 15 when the output torque of the motor 15 is equal to a required torque for the motor 15.

The output torque of the motor 15 increases in proportion to an increase in the applied voltage. The required torque for the motor 15 refers to the torque required by the motor 15 for enabling normal operations of the GM refrigerator (e.g., torque for driving the displacers 3*a* and 3*b* and the scotch yoke mechanism 22).

When an adequate voltage is applied to the motor 15, the output torque of the motor 15 exceeds the required torque so that the motor 15 would not fall out of synch (slip). When the out-of-synch voltage is relatively low, the required torque for operating the GM refrigerator may be relatively small. Thus, in such a case, even when some disturbance (e.g., momentary increase in friction generated at the displacers 3*a* and 3*b*) occurs, the required torque may not exceed the output torque of the motor 15.

On the other hand, when the out-of-synch voltage is relatively high, the required torque may be more likely to exceed the output torque when some disturbance occurs, and as a result, the motor 15 may be more likely to fall out of synch (slip). That is, when the out-of-synch voltage is relatively high, the motor 15 is more vulnerable to falling out of synch (slipping). Accordingly, a high out-of-synch voltage may not be desirable for purposes of ensuring stable operations of the GM refrigerator.

Referring to FIG. 8, when no working gas is supplied from the branch pipe 40 to the assist space 41, the assist space pressure is equal to 0.63 MPa (such a state being equivalent to the state of the conventional GM refrigerator). As can be appreciated, in most of the cases (A)-(D), the out-of-synch voltage of the GM refrigerator is at a highest value when the assist space pressure is at 0.63 MPa, and the motor 15 is most likely to fall out of synch (slip) in such a case.

Further, with regard to the case where the orientation angle of the GM refrigerator is 0 degrees and the case where the orientation angle of the GM refrigerator is 180 degrees, the out-of-synch voltage of the GM refrigerator is higher when the orientation angle of the GM refrigerator is 180 degrees compared to the case where the orientation angle of the GM refrigerator is 0 degrees, which means that the motor 15 is more likely to fall out of synch (slip) when the orientation angle is 180 degrees. This may be attributed to the weight of the displacer 3 being applied to the motor 15 as a motor load torque.

Also, as the assist space pressure within the assist space 41 is gradually increased, in the case where the orientation angle of the GM refrigerator is 0 degrees, the load on the motor 15 upon expanding the expansion chamber 11 becomes greater, and the out-of-synch voltage starts to rise around the point where the assist space pressure is equal to 1 MPa. In the case where the orientation angle of the GM refrigerator is 180 degrees, the weight of the displacer 3 is applied as a load on the motor 15 as described above, and as a result, the out-of-synch voltage keeps decreasing as the assist space pressure within the assist space 41 increases within the measurement range of FIG. 8. Further, in the cases where the orientation angle of the GM refrigerator is 90 degrees and 150 degrees, the out-of-synch voltage gradually decreases as the assist space pressure increases. In the case where the orientation angle of the GM refrigerator is 90 degrees, the out-of-synch voltage starts to increase around the point where the assist space pressure reaches 1.8 MPa.

Based on the measurement results indicated in FIG. 8, it can be appreciated that by setting the assist space pressure to be greater than or equal to 1.6 MPa and less than or equal to 1.8 MPa, the out-of-synch voltage may be reduced to a relatively low value regardless of the orientation angle of the GM refrigerator.

In the following, further embodiments of the present invention are described with reference to FIGS. 4-6.

Figure 4:
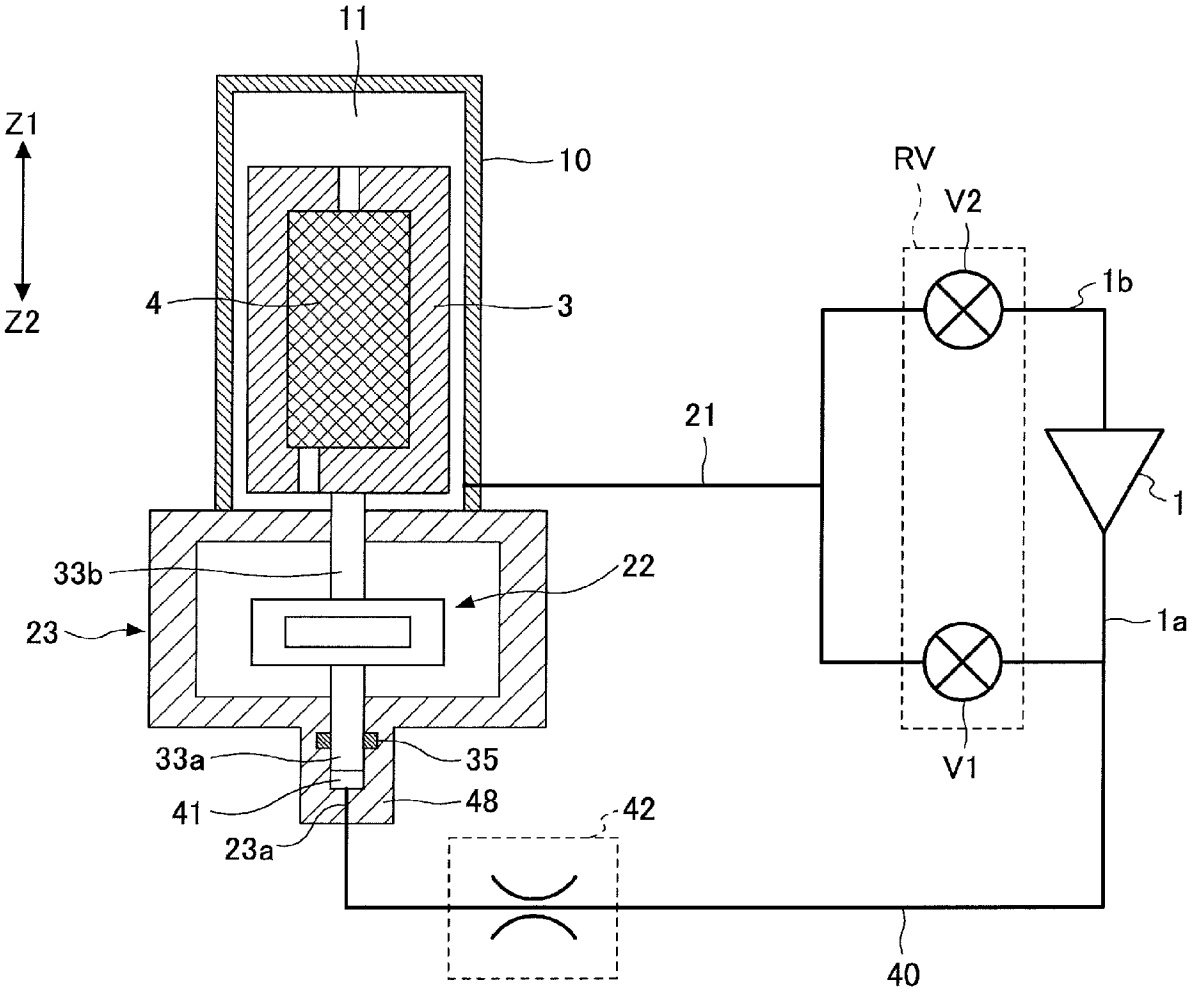
FIG. 4 illustrates a configuration of another GM refrigerator according to an embodiment of the present invention.
Figure 5:
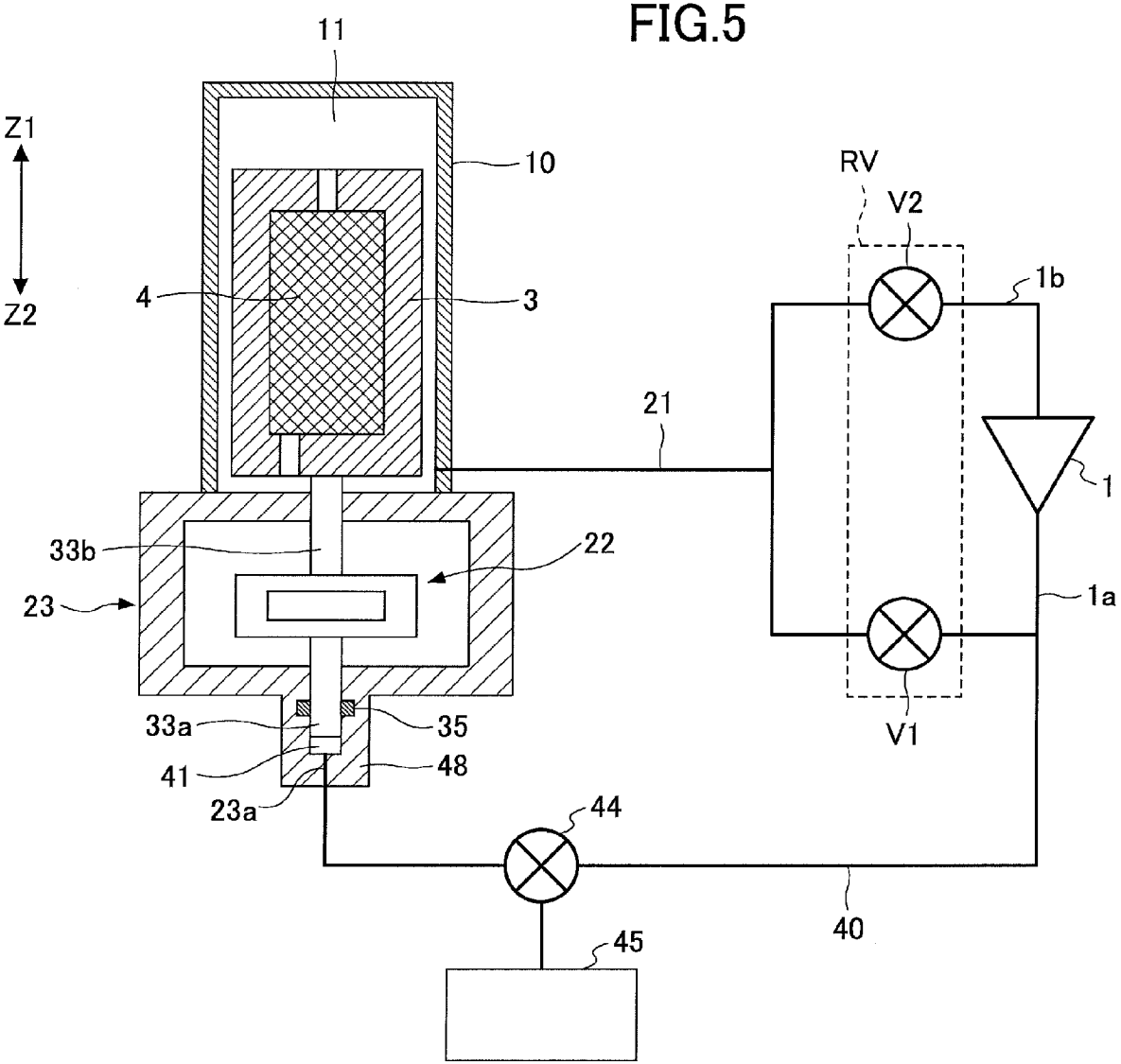
FIG. 5 illustrates a configuration of another GM refrigerator according to an embodiment of the present invention.
Figure 6:
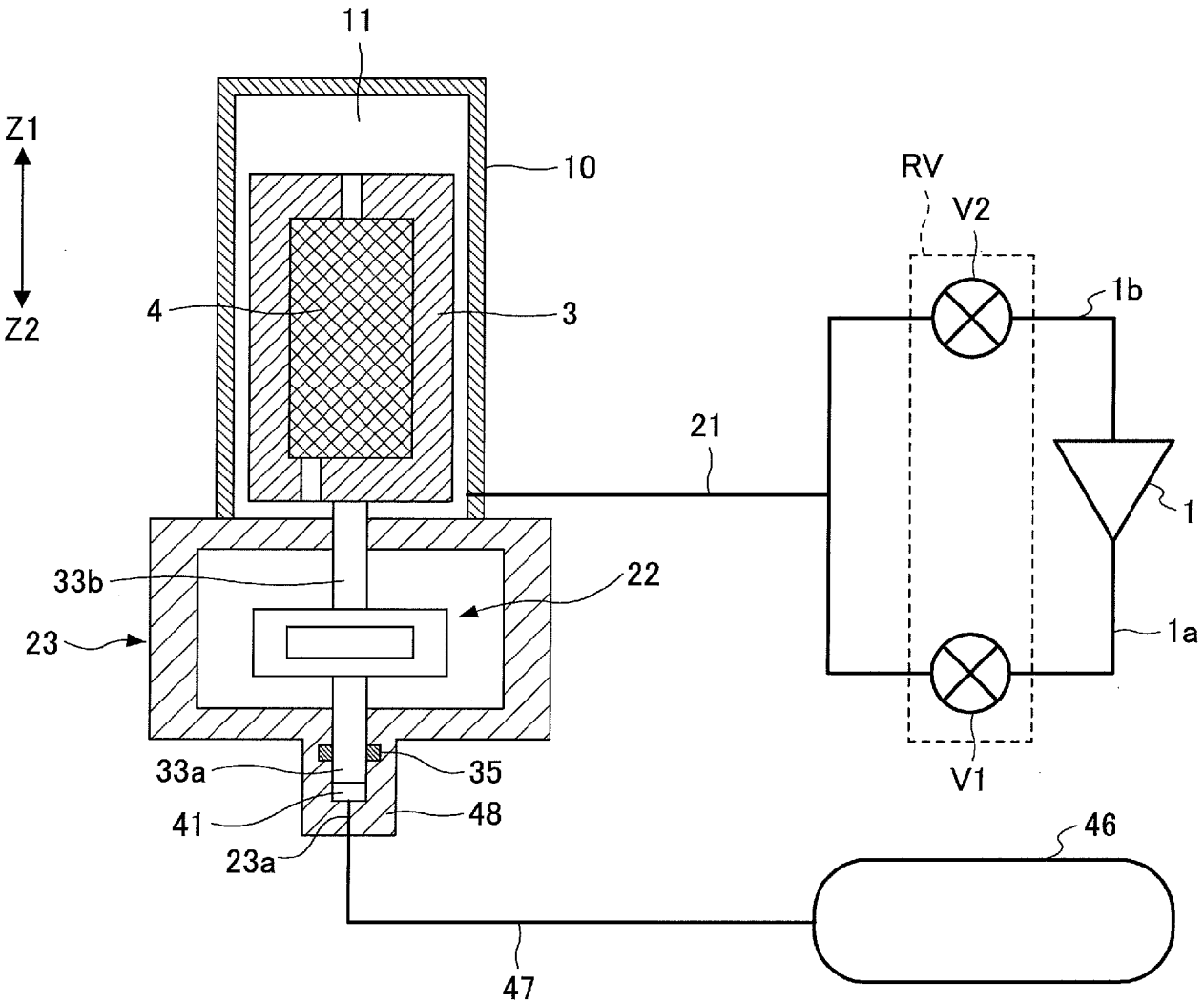
FIG. 6 illustrates a configuration of another GM refrigerator according to an embodiment of the present invention.

Note that features illustrated in FIGS. 4-6 that may be identical to the features illustrated in FIGS. 1-3 are given the same reference numerals and their descriptions are omitted.

FIG. 4 illustrates a configuration of a GM refrigerator according to a second embodiment of the present invention.

The GM refrigerator as illustrated in FIG. 4 has a depressurizing mechanism 42 arranged at the branch pipe 40, which branches out from the supply pipe 1*a* and is connected to the assist space 41. The depressurizing mechanism 42 is configured to depressurize the high-pressure working gas flowing through the branch pipe 40. For example, an orifice or a throttle valve may be used in the depressurizing mechanism 42.

By arranging the depressurizing mechanism 42 at the branch pipe 40 as described above, the assist space pressure within the assist space 41 may be maintained at a desired value and the assist force applied to the motor 15 may be stabilized, for example.

FIG. 5 illustrates a configuration of a GM refrigerator according to a third embodiment of the present invention.

The GM refrigerator as illustrated in FIG. 5 has a pressure control valve 44 arranged at the branch pipe 40, which branches out from the supply pipe 1*a* and is connected to the assist space 41. The pressure control valve 44 is configured to adjust the assist space pressure within the assist space 41. Further, a control unit 45 is connected to the pressure control valve 44*a*, and the control unit 45 controls the pressure control valve 44 to adjust the pressure within the assist space 41 to a predetermined pressure. By arranging the pressure control valve 44 at the branch pipe 40, the assist space pressure within the assist space 41 may be adjusted as desired, for example.

As described above with reference to FIG. 8, the out-of-synch voltage of the GM refrigerator may vary depending on its orientation angle. Accordingly, by arranging the pressure control valve 44 at the branch pipe 40 and controlling the pressure control valve 44 to adjust the assist force generated at the assist space 41 according to the orientation angle of the GM refrigerator, the assist force applied to the motor 15 may be more accurately controlled to prevent the motor 15 from falling out of synch.

FIG. 6 illustrates a configuration of a GM refrigerator according to a fourth embodiment of the present invention.

In the GM refrigerators described above, the branch pipe 40 branches out from the supply pipe 1*a*, which is arranged at the discharge port side of the compressor 1, and the branch pipe 40 is connected to the assist space 41. That is, the GM refrigerators described above are configured to use the compressor 1 as a high-pressure fluid source for generating the high-pressure working gas to be supplied to the assist space 41.

In contrast, the GM refrigerator as illustrated in FIG. 6 uses a buffer tank 46 as the high-pressure fluid source for supplying the high-pressure working gas to the assist space 41. The buffer tank 46 is configured to accommodate the high-pressure working gas to be supplied to the assist space 41.

An assist pipe 47 (corresponding to an exemplary embodiment of a supply pipe) is arranged to connect the buffer tank 46 to the assist space 41 formed at the housing 23. In this way, the high-pressure working gas within the buffer tank 46 may be supplied to the assist space 41 via the assist pipe 47.

Also, the pressure of the working gas within the buffer tank 46 is adjusted so that a predetermined assist force may be applied to the motor 15. By arranging the buffer tank 46 and the assist pipe 47 in the above-described manner, the motor 15 may be prevented from falling out of synch, for example.

Also, the buffer tank 46 is arranged outside the housing 23 and the assist pipe 47 is connected to the assist space 41 from outside the housing 23. In this way, the GM refrigerator of the present embodiment may be configured to apply an assist force to the motor 15 without complicating the structures of the housing 23 and the rotary valve RV.

Note that the high-pressure fluid accommodated within the buffer tank 46 is not limited to the working gas but may be some other type of fluid that is capable of generating the assist force for the motor.

Also, note that the present invention is widely applicable to various types of cryogenic refrigerators that are configured to drive a displacer using a drive shaft.

While certain preferred embodiments of the present invention have been described above, the present invention is not limited to these embodiments, and various changes and modifications may be made without departing from the scope of the present invention.

For example, although a slipper seal is arranged between the drive shaft and the housing in the embodiments described above, some other sealing mechanism may be used in other alternative embodiments of the present invention. The present invention also encompasses embodiments that do not include such a sealing mechanism. In the case where a sealing mechanism is not arranged between the drive shaft and the housing, the working gas supplied to the assist space 41 may flow into a space within the housing 23 that communicates with the suction port of the compressor 1. In this way, the working gas supplied to the assist space 41 may be prevented from flowing into the cylinder of the cryogenic refrigerator and may be prevented from directly affecting the cooling capacity of the cryogenic refrigerator, for example.

What is claimed is:

1. A cryogenic refrigerator, comprising:
- a compressor that compresses a working gas;
- a displacer to which the working gas compressed by the compressor is supplied;
- a drive mechanism that includes a drive shaft and is configured to drive the displacer;
- a motor that drives the drive mechanism;
- a housing that accommodates the drive mechanism;
- a valve mechanism that adjusts a pressure of the working gas supplied to the displacer;
- a pipe that supplies the working gas from the compressor to the valve mechanism;
- a branch pipe that branches out from the supply pipe and is connected to a space formed between the drive shaft and the housing and
- a slipper seal that is arranged between the drive shaft and the housing.

2. The cryogenic refrigerator as claimed in claim 1, wherein the branch pipe includes a depressurizing mechanism.

3. The cryogenic refrigerator as claimed in claim 2, wherein
- the depressurizing mechanism includes a pressure control valve and a control unit; and
- the control unit controls the pressure control valve to adjust a pressure within the space to a predetermined pressure.

4. A cryogenic refrigerator, comprising:
- a compressor that compresses a working gas;
- a displacer to which the working gas compressed by the compressor is supplied;
- a drive mechanism that includes a drive shaft and is configured to drive the displacer;
- a motor that drives the drive mechanism;
- a housing that accommodates the drive mechanism;
- a valve mechanism that adjusts a pressure of the working gas supplied to the displacer;
- a pipe that supplies the working gas from the compressor to the valve mechanism; and
- a branch pipe that branches out from the supply pipe and is connected to a space formed between the drive shaft and the housing, wherein the drive mechanism includes a scotch yoke mechanism.

5. The cryogenic refrigerator as claimed in claim 4, wherein the branch pipe includes a depressurizing mechanism.

6. The cryogenic refrigerator as claimed in claim 5, wherein
- the depressurizing mechanism includes a pressure control valve and a control unit; and the control unit controls the pressure control valve to adjust a pressure within the space to a predetermined pressure.

* * * * *